US010024020B2

(12) United States Patent
Fuller

(10) Patent No.: US 10,024,020 B2
(45) Date of Patent: Jul. 17, 2018

(54) APPARATUS FOR CONSTRUCTING FOUNDATION PILINGS

(71) Applicant: Andrew Corbin Fuller, Ridgeville, SC (US)

(72) Inventor: Andrew Corbin Fuller, Ridgeville, SC (US)

( * ) Notice: Subject to any disclaimer, the term of this patent is extended or adjusted under 35 U.S.C. 154(b) by 0 days.

(21) Appl. No.: 15/369,380

(22) Filed: Dec. 5, 2016

(65) Prior Publication Data

US 2018/0155893 A1 Jun. 7, 2018

(51) Int. Cl.

| | |
|---|---|
| ***E02D 5/56*** | (2006.01) |
| ***E02D 7/00*** | (2006.01) |
| ***E02D 7/22*** | (2006.01) |
| ***E02D 5/36*** | (2006.01) |
| *E02D 5/48* | (2006.01) |

(52) U.S. Cl.

CPC ..... *E02D 7/00* (2013.01); *E02D 5/36* (2013.01); *E02D 5/56* (2013.01); *E02D 7/22* (2013.01); *E02D 5/48* (2013.01); *E02D 2300/0029* (2013.01)

(58) Field of Classification Search

CPC .... E02D 5/24; E02D 5/28; E02D 5/48; E02D 5/52; E02D 5/523; E02D 5/526; E02D 5/56

USPC ..... 405/231–233, 236–237, 242, 244, 249, 405/251, 252, 252.1, 253

See application file for complete search history.

(56) References Cited

U.S. PATENT DOCUMENTS

| | | | | |
|---|---|---|---|---|
| 5,707,180 | A | 1/1998 | Vickars et al. | |
| 6,368,021 | B1 | 4/2002 | Strong et al. | |
| 6,652,195 | B2 * | 11/2003 | Vickars | E02D 5/36 175/262 |
| 7,546,887 | B2 * | 6/2009 | Schwab | E21B 7/005 175/323 |
| 8,033,757 | B2 | 10/2011 | Stroyer | |
| 8,506,207 | B2 * | 8/2013 | Lutenegger | E02D 5/56 175/323 |
| 8,926,228 | B2 | 1/2015 | Stroyer | |
| 9,631,335 | B2 * | 4/2017 | Reusing | E02D 5/56 |

(Continued)

FOREIGN PATENT DOCUMENTS

| | | | |
|---|---|---|---|
| GB | 2418949 A | * | 4/2006 |
| JP | 1-244015 A | * | 9/1989 |

OTHER PUBLICATIONS

Machine Translation of Japanese document JP 1-244015, Sep. 1989, 18 pages.*

*Primary Examiner* — Sunil Singh
(74) *Attorney, Agent, or Firm* — Nexsen Pruet, LLC; Angelica M. Colwell; Michael A. Mann

(57) ABSTRACT

Apparatus for making foundation pilings includes a lead section with screw threads, at least one extension section, and a bit carried by the first of the extension sections. The bit slides onto the first, lower end of the extension section and is operable to compress the soil laterally to the extension sections and form a lateral groove in the soil. Grout fills the annular region of the hole bored by the apparatus including the grooves for lateral stability. Each extension section is formed to fit into the next one and to be secured to it by lateral bolts. The bolt heads prevent the bit from moving vertically as the lead section advances into the soil. Bits may be added to increase the size of the opening bored.

16 Claims, 7 Drawing Sheets

(56) References Cited

U.S. PATENT DOCUMENTS

| | | | | |
|---|---|---|---|---|
| 2012/0114425 | A1 | 5/2012 | Seider et al. | |
| 2015/0117960 | A1* | 4/2015 | Kemp | E02D 5/56<br>405/252.1 |

* cited by examiner

APPARATUS FOR CONSTRUCTING FOUNDATION PILINGS

TECHNOLOGICAL FIELD

The present disclosure relates generally to foundation pilings. More specifically, the present disclosure relates to an apparatus for making foundation pilings.

BACKGROUND

Foundation pilings are used to support and stabilize structures, such as large and/or tall buildings, that cannot be adequately supported by the soil under the structure alone. Prior art friction pilings, which do not rest on a solid base such as rock, are understood to have a compressive capacity generally proportional to their length. Tension produced in soil surrounding the piling increases as soil is displaced during placement causing greater friction against the sides of the pilings. Pilings are usually made of timber, concrete or steel. Timber is the longest-used piling choice, being a natural, accessible, renewable resource. As other materials have developed, the choice has come to depend upon several factors including the environment where the pile will be placed.

Foundation pilings are particularly critical for structures built in areas known to have soft soils like oceanfront lots in coastal regions. Coastal regions have recently seen an increase in popularity and population and, as a result, construction of homes and other buildings. Soil near the coast has a higher water content and are less solid than inland areas, which are more solid and often have rock underneath the soils into which foundation pilings can be embedded. As a result, foundation pilings can support heavier loads in inland areas than in coastal areas.

Some coastal areas are also known to be prone to seismic activity, namely, earthquakes and tremors. Seismic activity presents another concern for construction since buildings are exposed to lateral tension, or sway left and right, during seismic activity. In areas having soft soils and seismic activity, foundation pilings provide adequate support for structures and making them better able to withstand small tremors or higher seismic activity in the soils.

There are several well-known methods for putting foundation pilings into place for construction. One widely-used method is to insert a piling column into a hole and then drive it down into the soil by pounding it with equipment fitted with a hydraulic ram, known as a pile driver. Driving piles requires prefabricated piles, which may be very long and heavy and require large, heavy equipment to transport the piles and to pound, i.e., drive, them into place, and the pounding creates considerable vibration and noise and is slow-going. Sometimes certain types of pilings cannot be pounded due to conditions of the soil at the site. Or, the choice of piling material will be dictated by the composition of the structure being constructed on the piles.

Another method for placing pilings, and alternative to driving, uses a helical screw mounted at the end of a shaft that can be screwed downward into soil until the screw is seated in a region of soil that sufficiently strong to support the weight that will be placed on the shaft. These are commonly referred to as "helical pier systems," one well-known example being the CHANCE helical pier system available from the A.B. Chance Company of Centralia, Mo., USA. Vickars, et al., U.S. Pat. No. 5,707,180 discloses a screw pier that is drawn downwardly into soil and attached to a shaft, typically having a square shape, that carries soil displacement means. Turning of the screw and shaft draws the soil displacement means through the soil forcing the soil out of a region around the shaft to create an opening that is then filled with grout that once solidified, encases the shaft and creates a column that becomes the foundation piling.

Addition of solidified grout increases the diameter of the piling beyond that of prior art pilings, which consisted of just the shaft placed in the soil. The significantly larger diameter of the solidified grout column is able to withstand more force before becoming displaced in comparison to a prior art helical pier in the same soil. As such, the solidified grout column has a significantly increased capacity for bearing compressive loads when compared to a prior art helical pier consisting only of a similarly-sized shaft and screw without grout.

In addition, "stepped pilings" are pilings that increase stepwise in diameter along their length and generally have greater load bearing capacities than pilings having a constant diameter. U.S. Pat. No. 6,652,195, also to Vickars, et al., discloses a method for making a "stepped pile" using a plurality of soil displacing members increasing in size spaced along the shaft attached to the screw pier, such that the opening created around the shaft is smallest nearest the screw pier and gradually becomes larger toward the end of the shaft nearest to the earth's surface.

Helical pier systems have been used for many years. These systems do not require pre-manufacture of large columns that are complicated to move or large equipment for placement of the pilings since the pilings are made at the site in the position where they are needed to provide support.

Construction demands in areas having soft soils and in areas where driven pilings cannot be used for some reason have created a need for a method to make foundation pilings that can withstand greater loads than the methods and pilings that are currently accepted and used. There is a need, whatever method is selected, for lessening the amount of time required to construct and place foundation pilings for construction projects because saving time saves money.

SUMMARY

The present disclosure describes an apparatus for making foundation pilings that comprise grout columns with steel cores. The steel core is largely the apparatus that is used to bore the hole for the piling and bores it with an annular region and including lateral grooves in the soil adjacent to the annular region.

The apparatus includes a lead section, pointed at its lower end and with at least a flight of a helical screw, which is attached to a first of several extension sections that are rotated about their vertical axes by a motor. The lead section is carried by the lowermost extension section. A bit is also carried by the lowermost extension section, its center being a cylindrical pipe that slips over the lower end of the extension section. The bit has a coupler attached to the cylindrical pipe that carries groove-forming teeth. The coupler, in addition to providing a surface to secure the teeth, also acts when rotating to compress the soil adjacent to the extension section and to enable the teeth it carries to form grooves in the wall of the annular region. Pairs of holes in the lead section and extension sections may be brought into registration to receive bolts that will hold them together and also prevent upward movement of the bit as the apparatus is rotated into the ground.

An aspect of the disclosure is an apparatus including a lead section having a first end and a second end opposing the first end, the first end being pointed and the second end having a pair of opposing holes formed therein. An extension section, having a first end and a second end opposing the first end, receives the second end of the lead section and itself has a first pair of opposing holes formed therein. The first pair of holes in the first end of the extension section is registrable with the pair of opposing holes of the second end of the lead section when the second end of the lead section is received into the first end of the extension section. Fasteners extend through the first pair of opposing holes of the first end of the extension section and the pair of opposing holes of the second end of the lead section when the first pair of opposing holes of the first end of the extension section are in registration with the pair of opposing holes of the second end of the lead section. The bit carried by the first end of the extension section is prevented from moving from the first end of the extension section toward the second end of the extension section by the fasteners.

Another aspect of the apparatus is that the lead section has a flight of helical threads on the first end to advance the lead section into the ground as that lead section is rotated.

Another aspect of the disclosure is that the bit has a coupler that provides an exterior surface for the attachment of at least one tooth extending laterally and also for compressing adjacent soil to form the annular region as the teeth carve grooves in the compressed soil thereby providing space for the grout and, because of the annular space and the grooves, increase lateral stability.

An aspect of the disclosure is that the center of the bit is a cylindrical pipe that can slide onto the first end of the first extension section. Additional bits that are similarly configured and with couplers that extend further radially so that their leading edges compress the soil even more, making a larger annual region. These wider couplers can be slid over subsequent extension sections just as the first one.

Another aspect of the disclosure is that the second end of an extension section has a second pair of holes formed therein so that subsequent extension sections may be joined to it.

An aspect of the disclosure is that the apparatus also may include grout and a motor for rotating the extension sections and lead section and bits.

Another aspect of the disclosure is an apparatus for constructing foundation pilings that includes a lead section having a first end and a second end opposing the first end. The first end carries at least one flight of screw threads; the second end has a pair of opposing holes formed therein. The apparatus also includes a first extension section having a first end and a second end opposing the first end. The first end of the first extension section is operable to receive the second end of the lead section. The first end of the first extension section has a first pair of opposing holes formed therein. The first pair of opposing holes in the first end of the first extension section are registrable with the pair of opposing holes of the second end of the lead section when the second end of the lead section is received into the first end of the first extension section. The first extension section has a second pair of opposing holes formed in the second end of the first extension section. The apparatus also includes a second extension section having a first end and a second end opposing the first end. The first end of the second extension section is operable to receive the second end of the first extension section. Moreover, the first pair of opposing holes in the first end of the first extension section are registrable with the pair of opposing holes of the second end of the lead section when the second end of the lead section is received into the first end of the first extension section. Similarly, the second set of opposing holes of the first extension section are registrable with the first set of opposing holes in the second extension section. Fasteners extend through the first pair of opposing holes of the first end of the first extension section and the pair of opposing holes of the second end of the lead section when the first pair of opposing holes of the first end of the first extension section are in registration with the pair of opposing holes of the second end of the lead section. The apparatus also includes a first bit carried by the first end of the first extension section and which is prevented from moving from the first end of the first extension section toward the second end of the first extension section by the fasteners.

Another aspect of the disclosure is the use of a second bit. The first bit has a first coupler and the second bit has a second coupler, and the second coupler extends laterally farther than the first coupler. Both bits carry teeth that extend laterally.

Those skilled in the art of foundation piling construction will appreciate these and other features of the disclosure from a careful reading of the Detailed Description accompanied by the drawings.

BRIEF DESCRIPTION OF THE DRAWINGS

Figure 1:
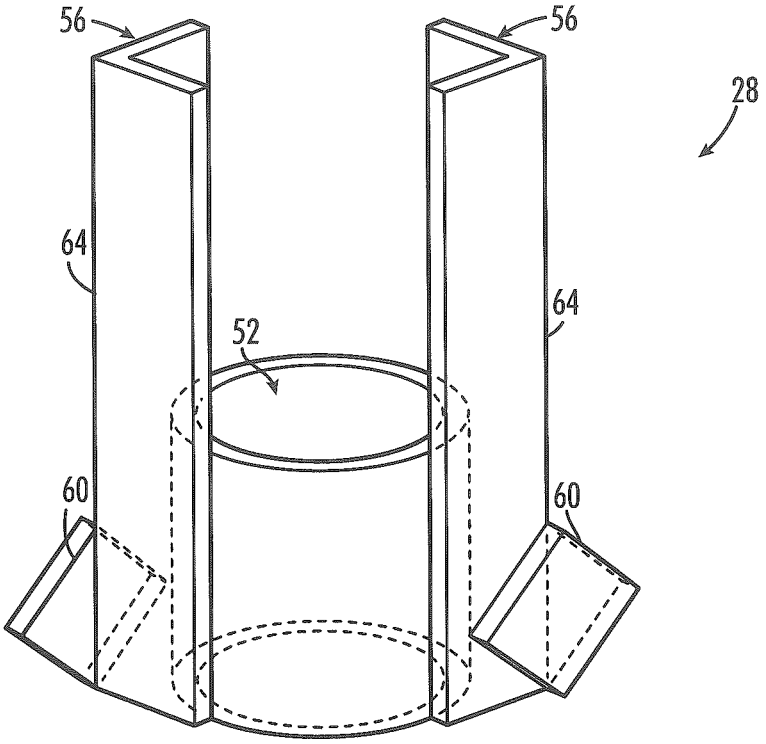
Figure 2:
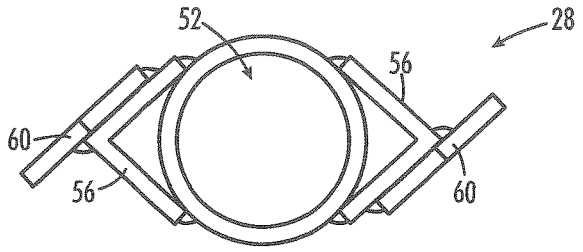
Figure 3:
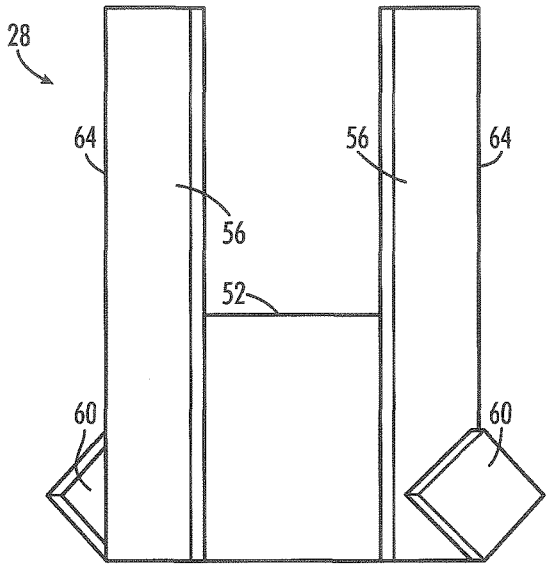
Figure 4:
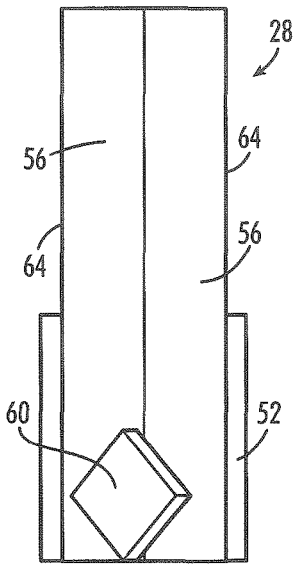
Figure 5:
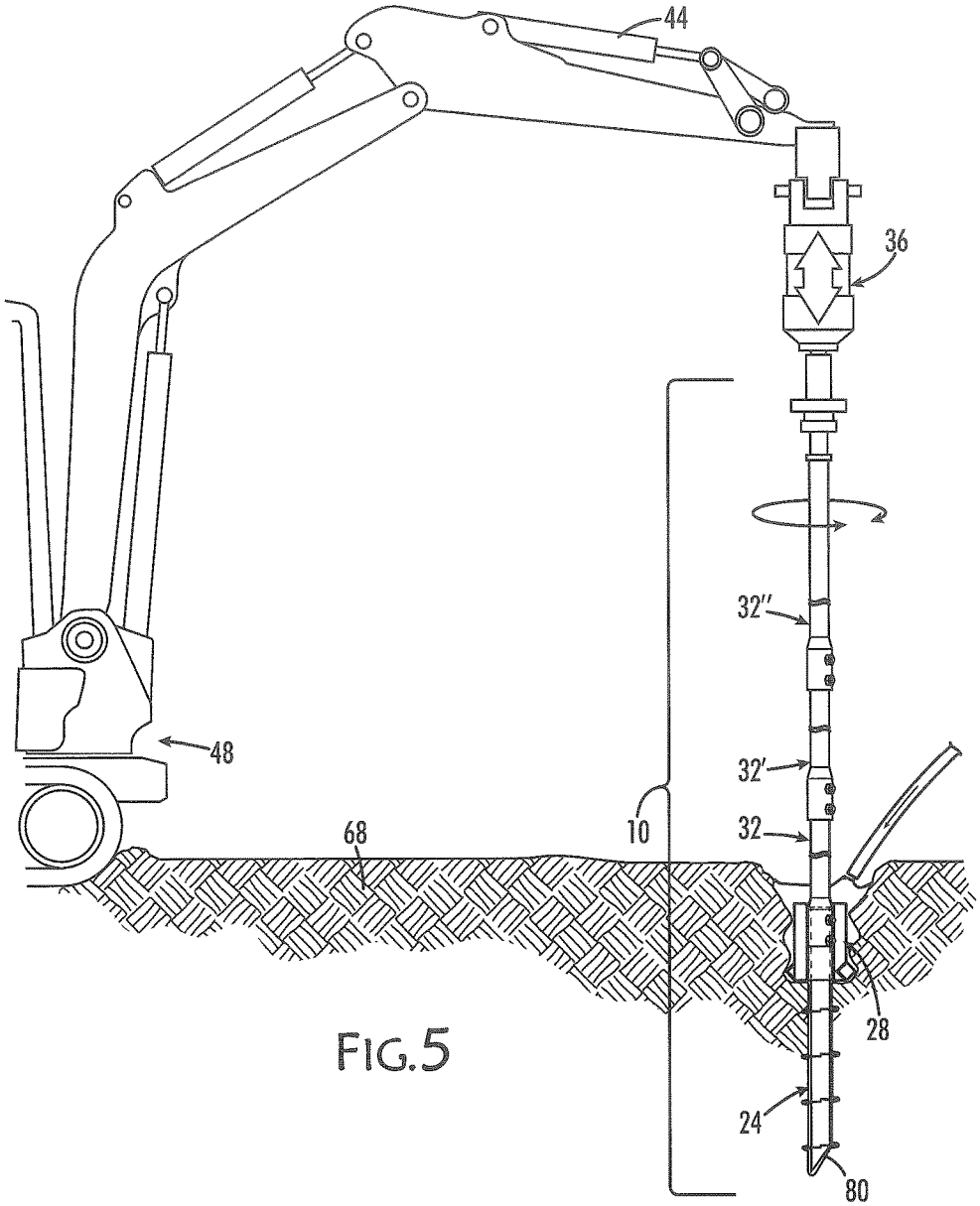
Figure 6:
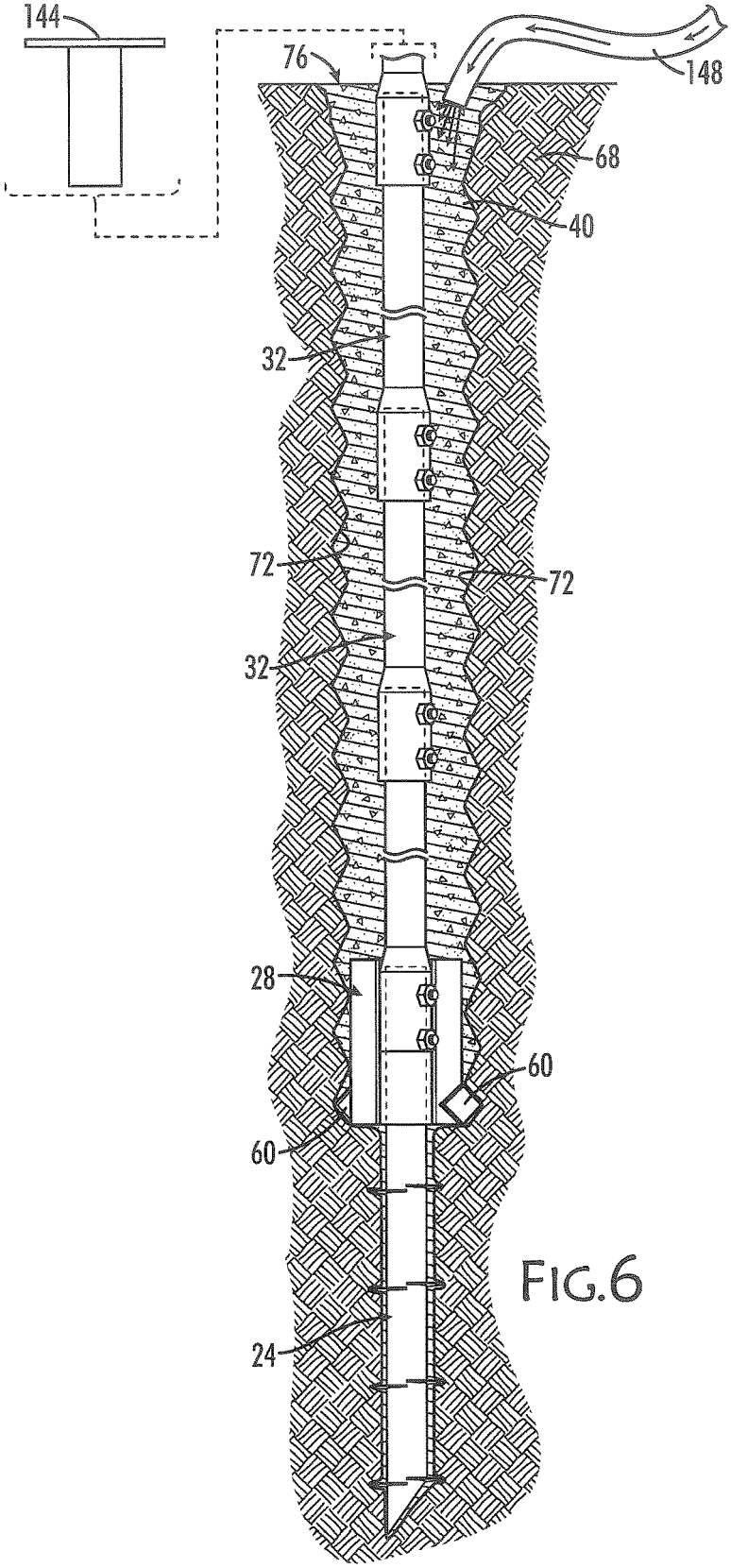
Figure 7A:
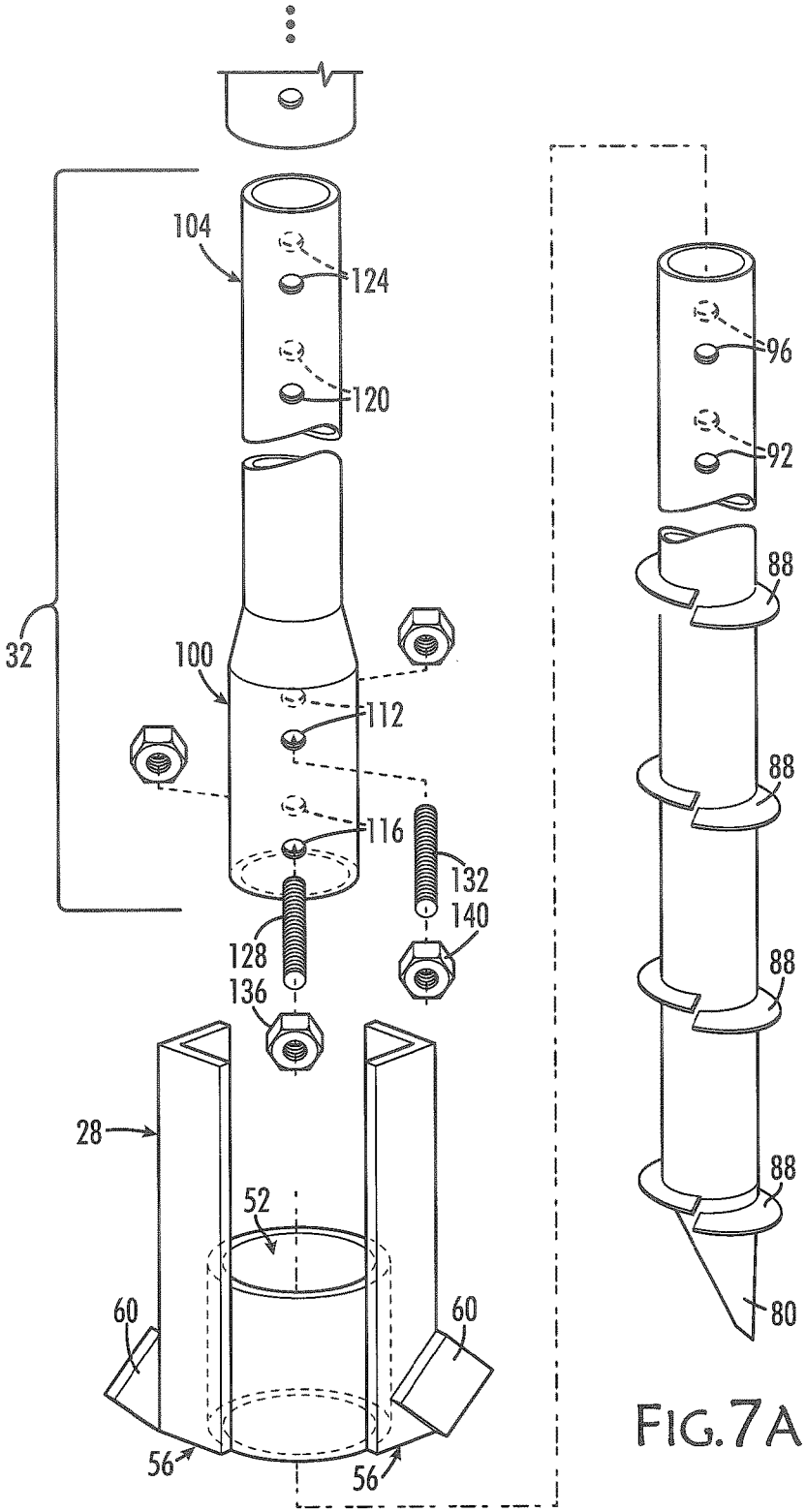
Figure 7B:
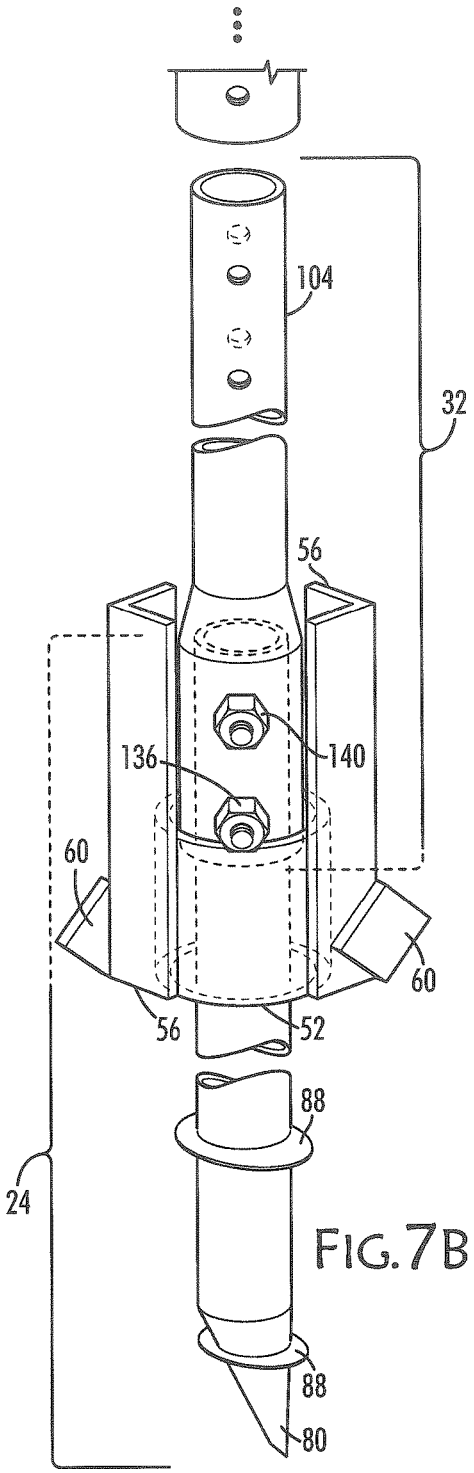
Figure 7C:
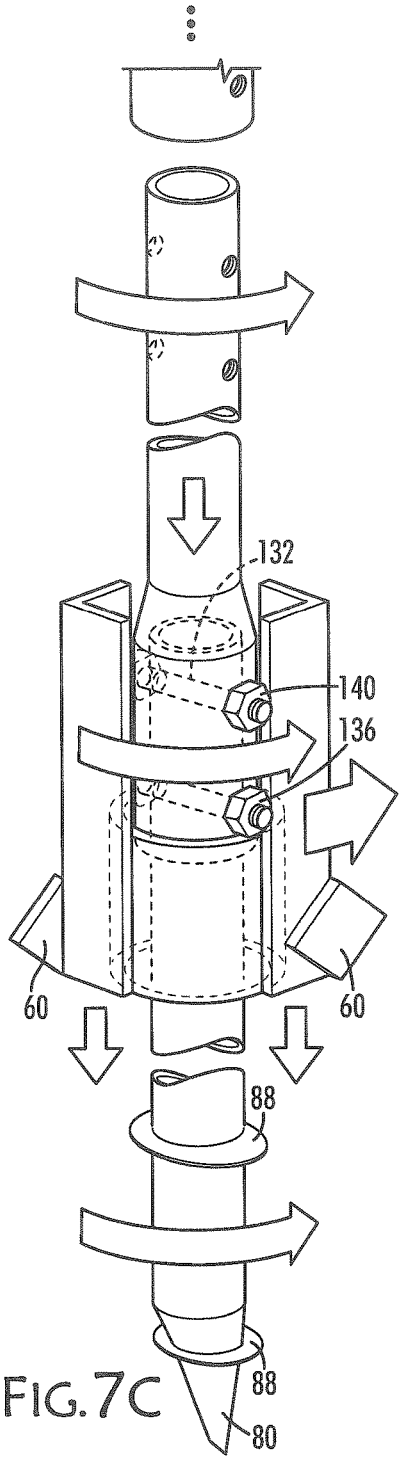
Figure 8:
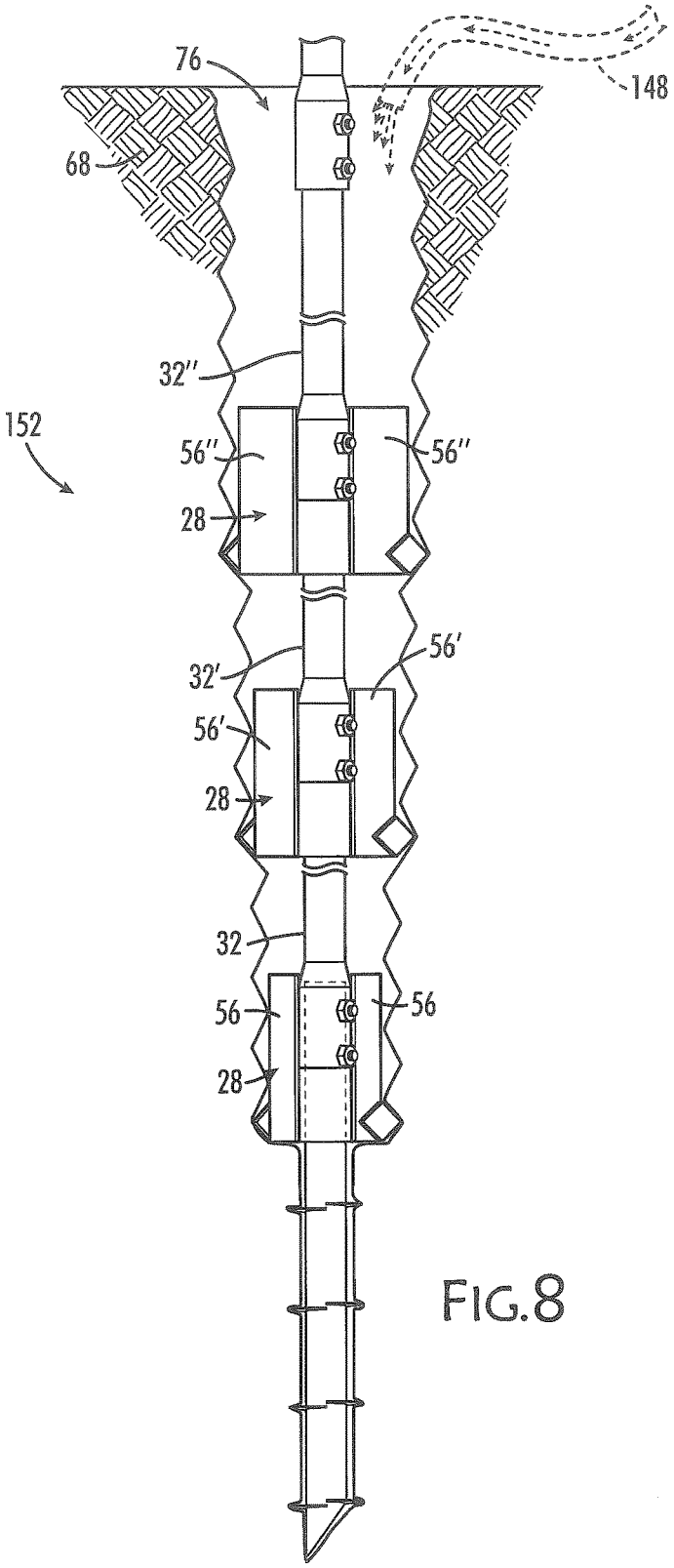

Having thus described variations of the disclosure in general terms, reference will now be made to the accompanying drawings, which are not necessarily drawn to scale, and wherein:

FIG. 1 is a perspective view of the bit according to an aspect of the disclosure;

FIG. 2 is a top view of the bit of FIG. 1;

FIG. 3 is a side view of the bit of FIG.;

FIG. 4 is an end view of the bit of FIG. 1;

FIG. 5 is a side, partially cross-sectional view of the apparatus for constructing a pile showing a lead section attached to three extension shafts, the first of which extension shafts having the bit of FIG. 1 installed on its first end, and which are being screwed into the soil using a motor on the end of a construction vehicle hydraulic arm to construct a foundation piling according to an aspect of the disclosure;

FIG. 6 is a side, partially cross-sectional view of a foundation piling being completed by the addition of grout in the annular region formed by the apparatus shown in FIG. 5, according to an aspect of the disclosure;

FIG. 7A is an exploded perspective showing an extension shaft, a bit, and a lead section and according to an aspect of the disclosure;

FIG. 7B is a side perspective view showing the bit installed on an extension section that is secured to a lead section;

FIG. 7C shows a side view of the apparatus of FIG. 7B rotated a quarter turn as indicated by the arrows; and FIG. 8 is a perspective view of a tapered foundation piling made with the bit according to an aspect of the disclosure.

DETAILED DESCRIPTION

There is herein disclosed apparatus for constructing foundation pilings. Referring now to the figures, an apparatus 10 is best seen in FIG. 5, and may include a lead section 24, a bit 28, one or more extension sections 32, 32', 32", a motor 36 for rotating lead section 24, bit 28, and extension sections 32, 32', 32", and grout 40. Apparatus 10 may be held in position over the designated location for a foundation pile by a hydraulic arm 44 of a construction vehicle 48 such as a backhoe or perhaps a crane.

Referring specifically to FIGS. 1-4, there is illustrated bit 28 in perspective, and in a top view, side view and end view, respectively. Bit includes a cylindrical pipe 52 dimensioned to receive extension section 32, as shown in FIG. 5. Attached to cylindrical pipe 52 are couplers 56. Couplers 56 serve two functions. They provide a surface on which to attach teeth 60 and they also provide a leading edge 64 that will press against the soil 68 of the wall 72 of the hold 76 (see FIGS. 5 and 6) to compress it, thereby leaving an annular region between extension 32 and wall 72 for grout 30.

Teeth 60 carve a groove in wall 72 that may also be filled with grout 40 and thereby increase lateral strength of the piling to be constructed.

Bit 28 may be made of steel, and therefore couplers 56 may be welded to cylindrical pipe 52 and teeth 60 welded to couplers 56. An aspect of the disclosure is that cylindrical pipe 52, couplers 56, and teeth 60 may be made of basic steel shapes, namely, steel pipe, angle steel, and steel plate so that they can be made inexpensively and quickly.

Referring to FIGS. 7A-C, lead section 24 has a first end 80 and a second end 84. For convenience, the term "first end" will refer to the lowermost end or first end into the hole being bored; likewise, the term second end will refer to the upper most end or the second end into the hole being bored. First end 80 is preferably closed and may be pointed to facilitate boring. At least one flight 88 of helical screw threads will assist in helping to advance lead section 24 into the soil. Lead section has at least one and may have two sets of opposing holes 92, 96, in its second end 84.

As shown in detail and, before being secured to lead section 24 in FIG. 7A and after, in FIGS. 7B and C, extension sections 32 may also be cylindrical and have a first end 100 and a second end 104. First end 100 is expanded to have a larger diameter than second end 104. Extension sections have at least one first pair of holes 112, 116, at said first end 100 and at least a second pair of holes 120, 124, at said second end 104. Holes 112, 116, may be 13/16" at three inches on center cut in opposing sides of pipe Bolts 128, 132 and nuts 136, 140, fasten second end 84 of lead section 24 to first end 100 of extension section 32. As shown in FIG. 7C, nuts 136, 140, like coupler 56, have a secondary function. They serve as stops to prevent bit 28 from moving upward when lead section is boring into the ground. As extension section 32 is screwed into the ground by lead section 24, soil 68 pushes bit 28 up until cylindrical pipe 52 butts up against nuts 136 carried by bolt 128 connecting extension section 32 to lead section 24. Bit 28 is secured in place by the upward pressure exerted by soil 68 surrounding bit 28. Use of nuts 136, 140, and the heads of bolts 128, 132, eliminates the need for any welding of bit 28 to extension section 32, which saves time in construction of the pilings and reduces overhead costs.

As the hole 76 is bored, it is filled with grout 40 in a liquid state, which, when cured, encases lead section 24, bit 28 and extension sections 32, 32', 32" and, once grout 40 is solidified, creates a solid, steel-reinforced, concrete column around them. This solid grout column bears the load of the structure after a cap 144 is applied. Cap 144 is embedded in the footing that supports the foundation slab.

Prior to practicing the method, an analysis of the soil at the site for construction is performed. Quality of the soil will indicate the number of foundation pilings that will be used to support the load of the structure to be constructed. Load is determined by the type of soil present on the construction site, which is determined by soil analysis. The size of lead section 24 may then be determined based on the calculated load. The size of the pipe shaft of extension sections, typically 3½ inches or 4½ inches in diameter, depends upon the load to be borne by the foundation piling.

Grooves 148 created in the wall 72 increase surface area of the soil 68 that will be in contact with grout 40, which increases capacity, in comparison to a prior art piling of the same length having a smooth-sided grout column. Because grooves 148 increase the amount of soil 68 in contact with grout 40, foundation piles made with apparatus 10 have increased compressive and lateral capacity in comparison to prior art helical pier systems having the same dimensions where the grout columns are smooth-sided. Capacity further increases as number of grooves 148 per meter of depth increases. Frequency of grooves 148 is determined by the speed at which extension section 32 is turned and downward pressure exerted by hydraulic arm 44 on motor 36 to drive lead section 24 through soil 68. Quality of soil 68 will determine the range of speed and pressure that can be applied.

Grooves 148 in wall 72 increase surface area of hole 76 in contact with grout 40. Increasing the surface area of grout 40 to soil 68 increases the skin friction or shear stress along the finished piling. Skin friction or shear stress is the principal source of vertical support for friction piles, which are known support loads in proportion to the length of the shaft of the pile, as opposed to end-bearing piles that are driven through soil to rest on rock or a very firm soil layer.

Bits 28 of different sizes can be installed onto extension sections 32, 32', 32" to create a tapered grout column in which extension sections 32, 32', 32" of the column increase in diameter toward the surface of the ground. Increases in girth of the column is understood to increase capacity of the piling. Bits 28 having couplers 56 that are wider and welded to cylindrical pipe 52 can be applied to extension sections 32', 32", to increase the diameter of the cavity that will form the grout column.

A foundation piling during construction according to the method is shown in FIG. 6. As shown in FIG. 5, lead section 24 is secured to extension section 32 carrying bit 28. Additional extension sections as can be accommodated by apparatus 10 are secured together to be screwed into soil 68 by motor 36. As lead section 24 screws into soil 68, bit 28 is pushed onto first end 100 of extension section 32. Bit 28 may be temporarily attached near second end 84 of lead section 24, above flight 88 with tape for convenience, so that it is held above the first end 80 of lead section 24. Bit 28 is pushed onto first end 100 of extension section 32 until cylindrical pipe 52 butts up against nuts 136.

As motor 36 continues driving lead section 24 further into the ground, hole 76 formed around outside of bit 28 is filled with grout 40 pumped from a supply through a hose 150 as hole 76 is created. Grout 40 is added as hole 76 is deepened by lead section 24 advancing downward through soil 68.

Tapered foundation pilings 152, as shown in FIG. 8 can also be made using the same size of extension section 32. Diameter of hole 76 is increased by applying bits having couplers 56', 56" that are incrementally wider to extension sections 32', 32". When wider, couplers 56', 56" increase the overall width of bit 28, meaning that hole 76 is widened when bit 28 turns in response to rotation of extension section 32. Tapered foundation pilings 152 can be made that incrementally taper up from 8 inches in diameter at the bottom of the grout column to 16 inches in diameter at the top. Grout would be added to hole 76 as suggested by showing hose 150 in dashed lines as hole 76 is created, but was not illustrated for clarity of the drawing.

What is claimed is:

1. A foundation piling, comprising:

(a) a lead section having a first end and a second end opposing said first end, said first end being pointed and said second end having a pair of opposing holes formed therein;

(b) an extension section having a first end and a second end opposing said first end, said first end of said extension section operable to receive said second end of said lead section and having a first pair of opposing holes formed therein, wherein said first pair of opposing holes in said first end of said extension section is registrable with said pair of opposing holes of said second end of said lead section when said second end of said lead section is received in said first end of said extension section;

(c) fasteners extending through said first pair of opposing holes of said first end of said extension section and said pair of opposing holes of said second end of said lead section when said first pair of opposing holes of said first end of said extension section are in registration with said pair of opposing holes of said second end of said lead section;

(d) a bit carried by said first end of said extension section and prevented from moving from said first end of said extension section toward said second end of said extension section by said fasteners, said bit including (i) a cylindrical pipe, (ii) a coupler welded to said cylindrical pipe, and (iii) teeth welded to said coupler, said teeth extending laterally and said coupler operable to form an annular space in soil around said bit with grooves formed in said soil by said teeth; and (e) grout in said annular space and said grooves.

2. The foundation piling of claim 1, wherein said lead section has a flight of helical threads on said first end.

3. The foundation piling of claim 1, wherein said bit is operable to slide onto said first end of said extension section.

4. The foundation piling of claim 1, wherein said second end of said extension section has a second pair of holes formed therein.

5. The foundation piling of claim 1, wherein said coupler has a leading edge when said bit is rotating, said leading edge operable to compress soil as said bit is being rotated.

6. The foundation piling of claim 1, further comprising a motor operable to rotate said extension section, said bit and said lead section rotating in response to rotation of said extension section.

7. A foundation piling, comprising:

a lead section having a first end and a second end opposing said first end, said first end being pointed and said second end having a pair of opposing holes formed therein;

an extension section having a first end and a second end opposing said first end, said first end of said extension section operable to receive said second end of said lead section and having a first pair of opposing holes formed therein, wherein said first pair of opposing holes in said first end of said extension section are registrable with said pair of opposing holes of said second end of said lead section when said second end of said lead section is received in said first end of said extension section;

fasteners extending through said first pair of opposing holes of said first end of said extension section and said pair of opposing holes of said second end of said lead section when said first pair of opposing holes of said first end of said extension section are in registration with said pair of opposing holes of said second end of said lead section;

a bit carried by said first end of said extension section and prevented from moving from said first end of said extension section toward said second end of said extension section by said fasteners, said bit including a cylindrical pipe dimensioned to receive said first end of said extension section therein;

a coupler welded to said cylindrical pipe, wherein said coupler has a leading edge;

at least one tooth carried by said bit, said at least one tooth extending laterally with respect to said bit and extending laterally with respect to said leading edge of said coupler, wherein said bit is operable to bore a hole having an annular region with lateral grooves formed therein, said leading edge of said coupler being operable to compress soil when said bit is penetrating said soil and rotating, and said at least one tooth is operable to carve said lateral grooves in the soil adjacent to the annular region formed by coupler of said bit; and grout in the annular region.

8. The foundation piling of claim 7, wherein said lead section has a flight of helical threads on said first end.

9. The foundation piling of claim 7, wherein said bit is operable to slide onto said first end of said extension section.

10. The foundation piling of claim 7, wherein said second end of said extension section has a second pair of holes formed therein.

11. The foundation piling of claim 7, further comprising a motor operable to rotate said extension section, wherein said bit and said lead section rotate in response to rotation of said extension section.

12. The foundation piling of claim 7, wherein said at least one tooth is at least two teeth.

13. The foundation piling of claim 7 wherein said coupler is made of steel.

14. The foundation piling of claim 7, wherein said coupler is made of angle steel.

15. The foundation piling of claim 7 wherein said at least one tooth is made of steel plate.

16. The foundation piling of claim 7, wherein said cylindrical pipe is steel pipe.

* * * * *